United States Patent [19]

Nagata et al.

[11] Patent Number: 4,660,501

[45] Date of Patent: Apr. 28, 1987

[54] COATING DEVICE

[75] Inventors: Tsuyoshi Nagata, Ibaraki; Katsuto Fujita, Osaka, both of Japan

[73] Assignee: Sunstar Giken Kabushiki Kaisha, Osaka, Japan

[21] Appl. No.: 736,304

[22] Filed: May 21, 1985

[51] Int. Cl.[4] ..... B05C 1/02

[52] U.S. Cl. ..... 118/203; 118/240; 118/256; 118/266; 901/43

[58] Field of Search ..... 118/203, 410, 266, 240, 118/242, 264, 267, 256, 207, 697; 901/29, 43

[56] References Cited

U.S. PATENT DOCUMENTS

| | | | |
|---|---|---|---|
| 2,718,870 | 9/1955 | McFarland | 118/203 |
| 3,088,434 | 5/1963 | Sprague et al. | 118/410 |
| 4,230,067 | 10/1980 | Iwamoto et al. | 118/264 X |
| 4,605,569 | 8/1986 | Shimada et al. | 118/203 X |

*Primary Examiner*—Evan K. Lawrence

*Attorney, Agent, or Firm*—Wegner & Bretschneider

[57] ABSTRACT

A coating device comprises a liquid composition supply unit for continuously supplying a liquid composition at a fixed rate, and coating unit for applying the liquid composition to a surface of an article to be coated, the coating unit comprising a coating head composed of a coating member mounted on a supporting frame pivotally mounted to the head and connected to the liquid composition supply unit, and a driving unit for moving the coating unit along the surface of the article to be coated. A preferred embodiment of the device includes an anti-curing unit for preventing curing of the liquid composition on a surface of the coating member, comprising an anti-curing tank provided with an opening through which the coating unit may come in and out of the tank and a shutter which is adapted to open and close the opening. The coating device is particularly useful for applying the liquid composition to an article with a three-dimensional curved surface.

6 Claims, 3 Drawing Figures

COATING DEVICE

FIELD OF THE INVENTION

This invention relates to a coating device and, more particularly, to a device for applying a volatile low-viscosity liquid composition to an article with a three-dimensional curved surface.

BACKGROUND OF THE INVENTION

In a manufacture of automobiles, installation of window glass is done by applying a primer to a periphery of window glass such as windshields and back windows preparatory to applying a sealing material to provide better adhesion for the sealing material.

Since the windshields and back windows have a three-dimentional curved surface, the application of the primer has been carried out manually with brushes or coating rollers, thus making it difficult to improve an efficiency of the coating works.

It is therefore a object of the present invention to provide a coating device which makes it possible to automatically and efficiently apply a volatile low-viscosity liquid composition to a surface of an article with a three-dimensional curved surface.

SUMMARY OF THE INVENTION

According to the present invention there is provided a coating device comprising a liquid composition supply unit for continuously supplying a liquid composition at a fixed rate, a coating unit for applying the liquid composition to a surface of an article to be coated, said coating unit comprising a coating head composed of a coating member and connected to the liquid composition supply unit, and a driving unit for moving the coating unit along the surface of the article to be coated.

A preferred embodiment of the coating device according to the present invention further comprises an anti-curing unit for preventing curing or setting of the liquid composition exposed on a surface of the coating member. The anti-curing unit comprises an anti-curing tank provided with an opening through which the coating unit may come in and out of the anti-curing tank, and a shutter mounted in the anti-curing tank and adapted to open and close the opening. The anti-curing tank is connected to a solvent supply unit for supplying vapor of a solvent to the anti-curing unit to prevent the liquid composition exposed on the surface of the coating member from curing.

The coating device according to the present invention makes it possible to automatically and efficiently apply a liquid composition to articles with a three-dimentional curved surface.

The invention will be further apparent from the following description with reference to the accompanying drawings which show, by example only, a preferred embodiment of the present invention.

PREFERRED EMBODIMENT OF THE INVENTION

Figure 1:
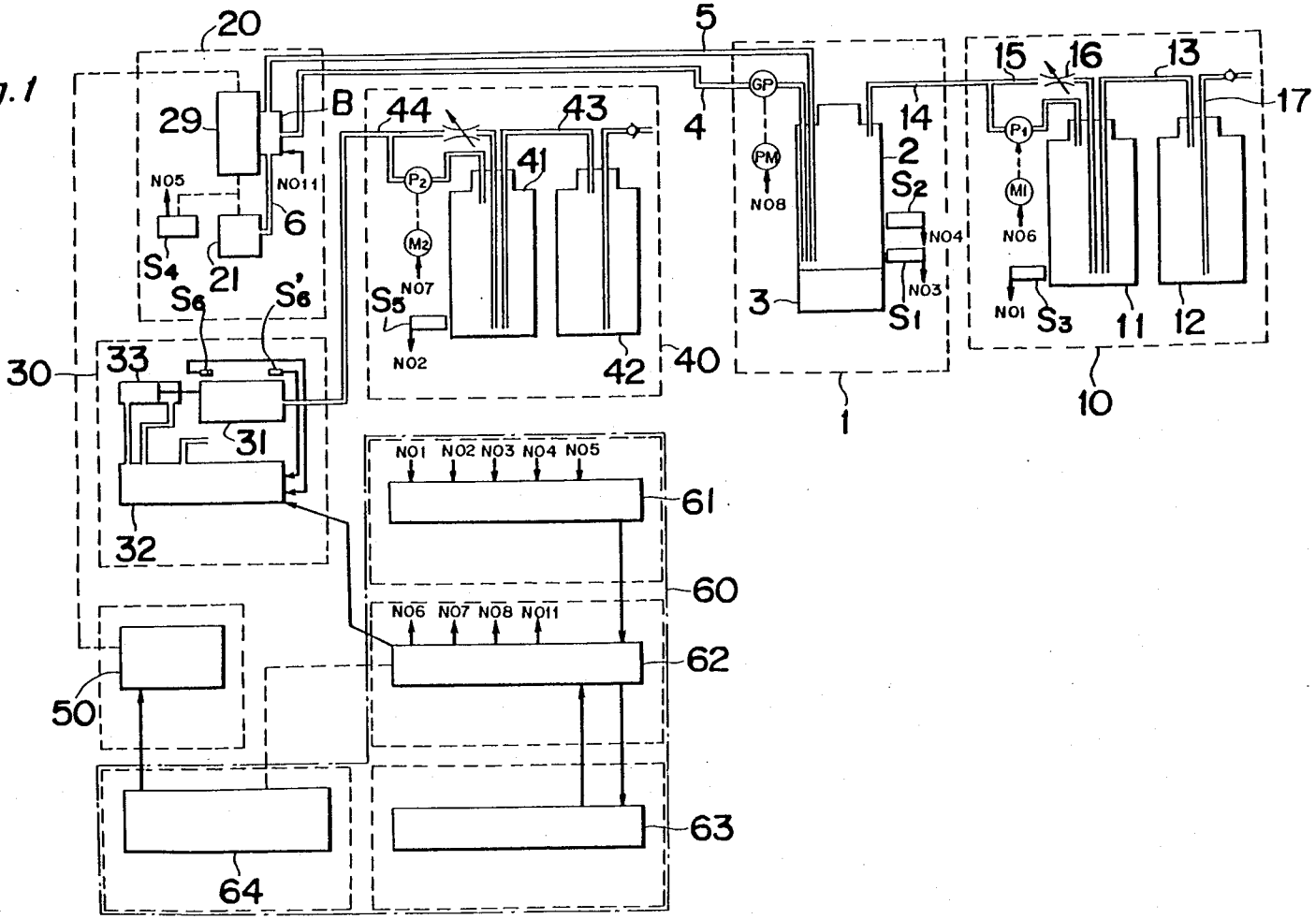
FIG. 1 is a block diagram of a system of a coating device according to the present invention.

Referring now to the drawings there is shown a coating device embodying the present invention adapted to apply a primer to windshields to be installed in a window frame of an automobile. The coating device comprises a liquid composition supply unit (1) for delivering a primer at a fixed rate, the first solvent supply unit (10) for supplying vapor of a solvent to the composition supply unit (1), a coating unit (20) comprising a coating head (21), an anti-curing unit (30) for preventing the primer on the coating member from drying and curing, the second solvent supply unit (40) for supplying vapor of a solvent to the anti-curing unit (30), a driving unit (50) for moving the coating unit along a surface of a windshield to be coated, and a control unit (60) for controlling the above units.

The liquid composition supply unit (1) comprises a tank (2) provided with a magnet stirrer (3), and a constant delivery pump such as a gear pump (GP) with a variable capacity of 0 to 100 ml/min. A pipe (4) terminates at its one end near a bottom of the composition supply tank (2) and is connected at its other end to a valve (B) of the coating unit (20). The pump (GP) is driven by a pulse motor (PM) controlled by a control part (62) of the control unit (60).

The tank (2) contains a primer composed of organic solvent type cold-setting paint of organosilane containing carbon black. In order to detect a liquid level of the primer in the tank (2), sensors ($S_1$) and ($S_2$) are provided on the side wall of the tank (2), and their signals are input to a warning part or I/O interface (61) of the control unit (60).

The first solvent supply unit (10) for supplying vapor to the tank (2) to prevent the primer from drying and curing comprises a solvent tank (11) containing a solvent, and a desiccating agent tank (12) containing a desiccating agent. The solvent tank (11) is connected to the primer tank (2) by a pipe (14) provided with a pump ($P_1$) to supply vapor of the solvent to the tank (2). The desiccating agent tank (12) is connected to the tank (11) by a pipe (13) to supply dry air thereto. The pipe (14) has a branched pipe (15) provided with a pressure control valve (16) to keep the pressure in the tank (2) constant.

In operation, the vapor of the solvent in the tank (11) is fed to the primer tank (2) through the pipe (14) by the pump ($P_1$), and dry air is sucked into the tank (11) from the desiccating agent tank (12) because of lowering of a pressure in the tank (11). This causes the flow of air in a pipe (17). The air is sucked into the tank (12) through the pipe (17), desiccated by the desiccating agent contained in the tank (12), and then sucked into the tank (11) through the pipe (13).

The pump ($P_1$) is driven by a motor ($M_1$) and controlled by on-off signals from the control part (62) of the control unit (60). As the pump ($P_1$), there may be used those such as micro-flow pumps or diaphragm pumps with a capacity ranging from 0.2 to 3.5 l/min. As the solvent, there may be used esters such as ethyl acetate; ketones such as acetone, methyl ethyl ketone; ethers such as ethyl ether and other organic solvents such as toluene. A level of the solvent in the tank (11) is detected by a sensor ($S_3$) mounted on the side wall of the tank (11), and the signals from the sensor ($S_3$) are input to the I/O interface (61) of the control unit (60).

Figure 2:
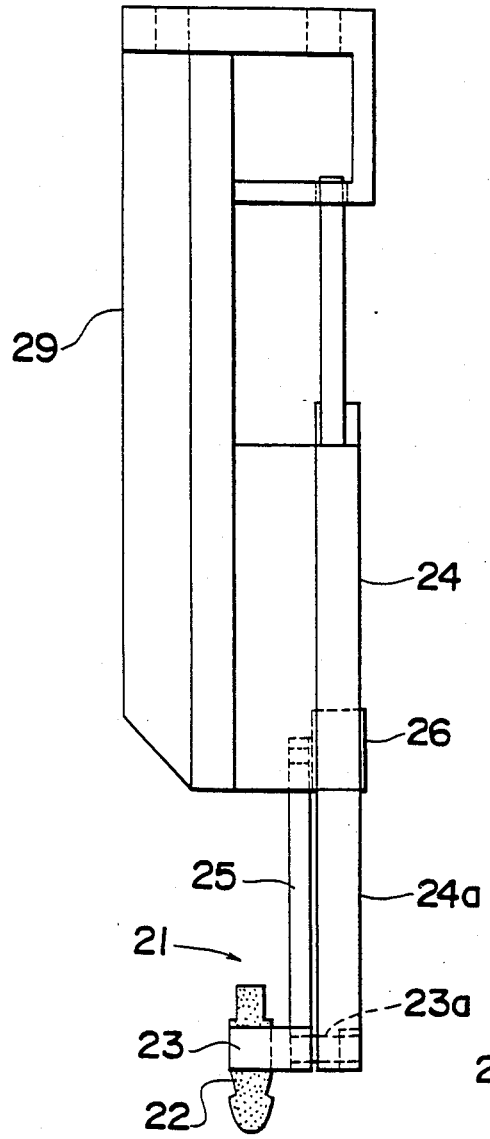
FIG. 2 is a side view of a coating unit of the coating device of FIG. 1; and, FIG. 3 is a front view of the coating unit of the FIG. 2.
Figure 3:
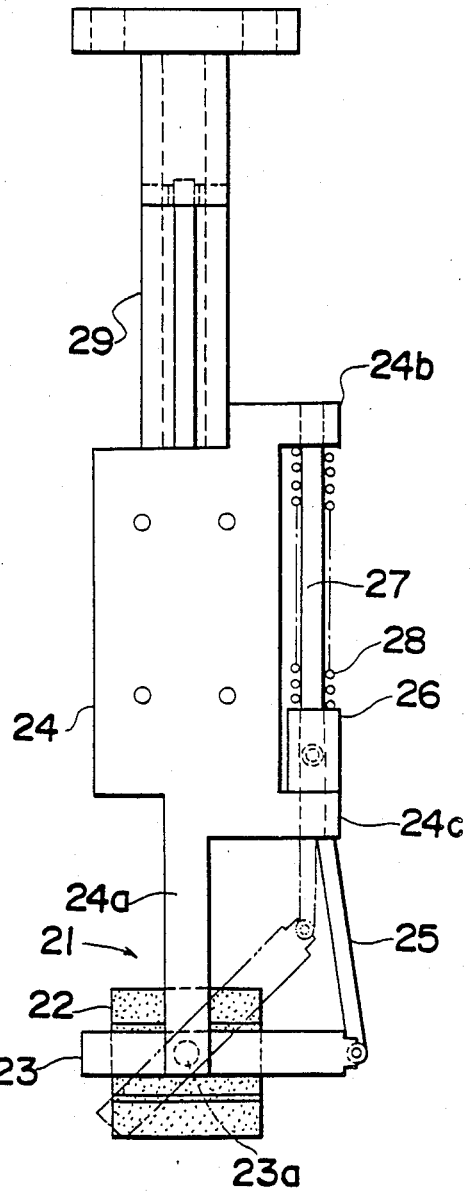

The coating unit (20) comprises a coating head (21), a holder (29), and a valve (B) mounted on the holder (29). The valve (B) is connected to the composition supply tank (2) by the pipe (4) and a pipe (5) adapted to return vapor generated in the valve (B) to the tank (2). As shown in FIGS. 2 and 3, the coating head (21) comprises a coating member (22) composed of a sponge-like porous material, and a supporting frame (23) rotatably mounted on a lower end of a projection (24*a*) of an attachment (24) by a pin (23*a*). The coating member (22) is held between the supporting frame (29) and connected at its one end to the valve (B) by a pipe (6). In order to allow the coating member (22) to follow up changes of a curved surface of the article to be coated, the supporting frame (23) is connected to slider (26) which is slidably mounted on a shaft (27) arranged between two projections (24*b*), (24*c*) of the attachment (24). The slider (26) is forced towards the projection (24*c*) by a coil spring (28) mounted on the shaft (27). An arm (25) is pivotally connected at its one end to one end of the supporting frame (23) and at its other end to a slider (26).

The coating member (22) is connected at its top end to the valve (B) by a pipe (6) and supplied with the primer from the tank (2) of the liquid composition supply unit (1) by the gear pump (GP). The primer fed to the coating member (22) passes through a core provided therein and oozes out from pores of the coating member (22).

The holder (29) is attached at its upper end to an arm (not shown) of the driving unit or robot (50) for moving the coating unit (20). The robot (50) is designed so as to move the coating member (22) along the periphery of the article to be coated, such as window glass.

The robot (50) is controlled by a robot controller (64) of the control device (60). In order to detect a position of the coating member (22) there is provided a sensor ($S_4$) and signals therefrom are input to the I/O interface (61) of the control unit (60). The valve (B) is opened and closed by on-off signals from the control part (62) of the controller unit (60).

In this embodiment, in order to apply the liquid composition to the periphery of the window glass with a three-dimentional curve surface, the robot (50) is controlled so that the sponge-like coating member (22) is moved along the periphery of the window glass and may follow up the change of the three-dimensional curved surface of the glass. Since the supporting frame (23) is pivotally mounted on the attachment (24) and is connected at its one end to the slider (26) by the arm (25), the coating member (22) may rotate round the pin (23*a*) in clockwise or vice versa in FIG. 3. When the coating member (22) runs on a convex surface of the glass, it rotates round the pin (23*a*) together with the supporting frame (23) against the force of the coil spring (28), and then reversely rotates by the force of the coil spring (28) when it goes down.

The anti-curing unit (30) comprises a anti-curing tank (31) provided with a shutter (not shown) operated by an air cylinder (33). Sensors ($S_6$), ($S_6'$) are provided for detecting the presence of the coating head (21). The output signals of the sensor ($S_6$), ($S_6'$) are input to the controller (32).

If the coating device is not in use, the coating head (21) is moved into the anti-curing tank (31) by the robot (50), and kept therein to prevent the primer on the coating member from drying and curing until coating work is restarted. The approach of the coating head (21) to the anti-curing tank (31) is detected by the sensors ($S_6$), ($S_6'$) and their signals are input to the control unit (60) to open the shutter of the tank (31) by the air cylinder (33). After the the coating head (21) is positioned in the tank (31), the shutter is closed. If the starting signal of the coating is input to the control unit, the air cylinder (33) opens the shutter, and then the coating unit is moved to the coating position. After the coating head is carried out from the tank, the shutter is again closed The second solvent supply unit (40) is provided to supply vapor of a solvent to the anti-curing tank (31). The unit (40) has the same construction as that of the first solvent supply unit (10) and comprises a solvent tank (41), a desiccating agent tank (42) connected to the solvent tank (41) by a pipe (43). The solvent tank (41) is connected to the anti-curing tank (31) by a pipe (44) provided with a pump ($P_2$). This pump ($P_2$) has a capacity ranging from 200 to 300 ml/min and is driven by a motor ($M_2$) controlled by the on-off signals from the control part (62) of the control unit (60). The solvent which is the same as that in the first solvent supply unit (10) is fed to the anti-curing tank (31) by the pump ($P_2$). A sensor ($S_5$) is provided on the tank (41) to detect a level of the solent, and its signal is input to the I/O interface (61) of the control unit (60).

The control unit (60) comprises an I/O interface (61) receiving signals from the sensors ($S_1$) to ($S_6$), a controller (62) for controlling motors ($M_1$), ($M_2$), (PM) valve (B), an air cylinder (33), a flow rate display unit (63), and a robot controller (64) for controlling the robot (50).

In operation, the primer is pumped up by the gear pump (GP) and supplied to the valve (B) of the coating unit (20) through the pipe (4). During operation, the primer is stirred by the magnet stirrer (3). The primer then flows out from the pores of the coating member (22) and is coated on the periphery of window glass since the coating head (21) is moved along the periphery of the glass. The primer is delivered from the gear pump (GP) at a predetermined constant rate, and the amount of the primer is closely controlled by controlling the pulse motor (PM).

The coating head (21) is controlled its position by the robot (50), thus making it possible to apply the primer automatically to the surface of the glass to be coated. Thus, the present invention makes it possible to improve efficiency of the coating work. Since the coating member (22) is rotatably mounted on the supporting member and is forced downwardly, the coating member (22) follows up the change of the complex three-dimensional curved surface of the article to be coated during movement.

Further, since the coating device has the anti-curing device (32), it is possible to prevent the primer on the surface of the coating member from curing when the device is not in use.

Although one preferred embodiment has been described in detail, it will be obvious that the present invention is not limited to the above example only and may be varied in any ways. Such variations are not to be regarded as a departure from the spirit and scope of the present invention, and such modifications are included within the scope of the present invention.

What we claim is:

1. A coating device comprising a liquid composition supply unit for continuously supplying a liquid composition at a fixed rate and a coating unit for applying the liquid composition to a surface of an article to be coated, said coating unit comprising a coating head, on which is pivotally mounted a supporting frame which has a coating member mounted thereon, said coating head being connected to said liquid composition supply unit, and a driving unit for moving the coating head along the surface of the article to be coated; and further comprising an anti-curing unit for preventing curing of the liquid composition on a surface of the coating member, comprising an anti-curing tank provided with an opening through which the coating unit may come in and out of the anti-curing tank and a shutter which is adapted to open and close the opening.

2. A coating device as claimed in claim 1, wherein the liquid composition supply unit comprises a liquid composition tank and a first pump for delivering the liquid composition from the liquid composition tank to the coating head at a fixed rate, and wherein the device further comprises a solvent supply unit for supplying vapor of a solvent to the liquid composition tank, comprising a solvent tank connected to the liquid composition tank, a second pump to supply the solvent vapor from the solvent tank to the liquid composition tank and a pressure control valve to keep the pressure in the liquid composition tank constant.

3. A coating device for applying a liquid composition to a three-dimensional curved surface of an article to be coated comprising:

(a) a liquid composition supply unit comprising a liquid composition tank and a first pump for delivering the liquid composition from the tank at a fixed rate;

(b) a coating unit for applying the liquid composition to the three-dimensional curved surface of the article to be coated, comprising a holder, an attachment mounted on the holder, and a coating head mounted on the attachment and connected to the liquid composition pump through a first pipe, said coating head comprising a supporting frame and a sponge-like coating member mounted on the supporting frame for applying the liquid composition to the three-dimensional curved surface of the article to be coated, said supporting frame being pivotally mounted on the attachment and pivotally connected at its one end to a slider by means of an arm, said slider being slidably mounted on the attachment and biased downwardly by a spring to allow the coating member to follow changes of the curved surface of the article to be coated; and (c) a driving unit for moving the coating unit along the surface of the article to be coated, said holder being attached to the driving unit.

4. The coating device as claimed in claim 3, wherein said first pump comprises a gear pump with a variable capacity and is driven by a pulse motor to deliver the liquid composition at a predetermined constant rate to a valve mounted on the holder of the coating unit, and wherein the coating member is connected to the valve.

5. The coating device as claimed in claim 3, further comprising a first solvent supply unit for supplying vapor of a solvent to the liquid composition tank, said first solvent supply unit comprising a solvent tank connected to the liquid composition tank through a second pipe, a second pump to supply vapor of the solvent from the solvent tank to the liquid composition tank, and a pressure control valve to keep the pressure in the liquid composition tank constant.

6. The coating device as claimed in claim 3 further comprising an anti-curing unit for preventing the liquid composition on the coating member from drying and curing, said unit comprising an anti-curing tank provided with an opening through which the coating unit may come in and out of the anti-curing tank, and a shutter mounted in the anti-curing tank which is adapted to open and close the opening.

* * * * *